US007458580B2

(12) United States Patent
Martineck et al.

(10) Patent No.: US 7,458,580 B2
(45) Date of Patent: Dec. 2, 2008

(54) LOTTERY GAME CARD HAVING A SUDOKU GAME

(75) Inventors: Jeffrey Martineck, Alpharetta, GA (US); S. Kyle Rogers, Cumming, GA (US); Jennifer M Welshons, Aplharetta, GA (US); Paul Guziel, Roswell, GA (US)

(73) Assignee: Scientific Games International, Inc., Newark, DE (US)

( * ) Notice: Subject to any disclaimer, the term of this patent is extended or adjusted under 35 U.S.C. 154(b) by 57 days.

(21) Appl. No.: 11/594,371

(22) Filed: Nov. 8, 2006

(65) Prior Publication Data

US 2007/0138740 A1 Jun. 21, 2007

Related U.S. Application Data

(60) Provisional application No. 60/734,642, filed on Nov. 8, 2005.

(51) Int. Cl.
*A63F 3/06* (2006.01)

(52) U.S. Cl. ..... 273/139; 273/269; 273/272; 273/271; 283/901; 283/903

(58) Field of Classification Search ..... 273/139, 273/269, 138.1, 272, 271; 283/901, 903
See application file for complete search history.

(56) References Cited

U.S. PATENT DOCUMENTS 1,527,929 A 2/1925 Simons
3,699,311 A 10/1972 Dunbar
3,826,499 A 7/1974 Lenkoff
3,918,174 A 11/1975 Miller et al.
4,095,824 A 6/1978 Bachman
4,191,376 A 3/1980 Goldman et al.
4,241,942 A 12/1980 Bachman
4,398,708 A 8/1983 Goldman et al.
4,466,614 A 8/1984 Bachman et al.
4,491,319 A 1/1985 Nelson
4,579,371 A 4/1986 Long et al.
4,591,189 A 5/1986 Holmen et al.
4,740,016 A 4/1988 Konecny et al.
4,764,666 A 8/1988 Bergeron
4,964,642 A 10/1990 Kamille
5,074,566 A 12/1991 Desbiens
5,118,109 A 6/1992 Gumina
5,158,293 A 10/1992 Mullins
5,193,815 A 3/1993 Pollard
5,193,854 A 3/1993 Borowski, Jr. et al.
5,273,281 A 12/1993 Lovell (Continued)

FOREIGN PATENT DOCUMENTS

GB 2075918 A 11/1981

*Primary Examiner*—Benjamin H Layno
(74) *Attorney, Agent, or Firm*—Dority & Manning, P.A.

(57) ABSTRACT

A lottery game card including a plurality of squares distributed in a matrix format, and a plurality of game indicia initially covered by a removable material. Each squares of the matrix are populated with a game symbol and some of the squares of the matrix are covered by the removable material, forming a Sudoku puzzle. A player may play the Sudoku puzzle using the matrix. The player may remove the removable material from the game indicia and covered squares. If the squares identified by the game indicia form a predefined pattern, a prize is awarded to the player.

8 Claims, 10 Drawing Sheets

U.S. PATENT DOCUMENTS 5,451,052 A 9/1995 Behm et al.
5,769,458 A 6/1998 Carides et al.
5,772,509 A 6/1998 Weiss
5,782,470 A * 7/1998 Langan ..... 273/139
5,887,906 A 3/1999 Sultan
5,911,418 A 6/1999 Adams
6,206,373 B1 3/2001 Garrod
6,224,055 B1 5/2001 Walker et al.
6,241,246 B1 6/2001 Guttin et al.
6,273,817 B1 8/2001 Sultan
6,379,742 B1 4/2002 Behm et al.
6,637,747 B1 10/2003 Garrod
6,648,755 B1 11/2003 Luciano et al.
6,676,126 B1 1/2004 Walker et al.
6,802,505 B2 * 10/2004 Jeon ..... 273/139
6,889,978 B2 5/2005 Schaefer et al.
2002/0003335 A1 1/2002 Schaefer et al.
2004/0178582 A1 9/2004 Garrod
2005/0035547 A1 2/2005 Henry
2005/0093228 A1 5/2005 Brian, III

* cited by examiner

LOTTERY GAME CARD HAVING A SUDOKU GAME

CROSS REFERENCE TO RELATED APPLICATION

This application claims the priority of the U.S. Provisional Patent Application, 60/734,642, Game Ticket And Method of Play, filed on Nov. 8, 2005, the content of which is incorporated in its entirety by this reference.

BACKGROUND OF THE INVENTION

1. Field of the Invention

The invention relates in general to instant win or scratch off tickets or games, and more particularly to lottery game tickets styled as Sudoku themed games, and methods of playing same.

2. Description of Related Art

In a typical scratch-off lottery game, a player purchases a pre-printed scratch-off lottery game card with some spots covered by a removable material and scratches off the removable material from few selected spots. If these scratched spots reveal some desired pattern or numbers, the player wins one or more prizes. If the player does not win any prize, the lottery game card typically loses immediately its value and does not serve for any additional purpose.

Therefore, it is desirable to have a lottery game card that provides additional entertainment to players after the payment determination is made, and it is to such method the present application is primarily directed.

SUMMARY OF THE INVENTION

In one embodiment, there is provided a scratch-off lottery game card with a Sudoku puzzle. The lottery game card includes a substrate, a plurality of squares placed on the top of the substrate, a plurality of game symbols, and a plurality of game indicia initially covered by a removable material. The plurality of squares is distributed in a N×N matrix. Each game symbol is placed inside a square, and some game symbols are initially covered by a removable material. The plurality of squares with some game symbols uncovered form a Sudoku puzzle. If the game symbols identified by the game indicia form a predefined pattern, a prize is awarded to a player holding the lottery game card.

In another embodiment, there is provided a method for playing a scratch-off lottery game in which a scratch-off game card with a plurality of squares is provided to a player. Each square is filled with a game symbol. Selected squares of the plurality of squares are covered by a removable material and form a Sudoku puzzle. The scratch-off lottery game further comprises a plurality of game indicia initially covered by the removable material. The method comprises removing the removable material from the plurality of game indicia, wherein each game indicia identifies a square, removing the removable material from the selected squares covered by the removable material, and if the digits in the squares identified by the plurality of game indicia form a predefined pattern, awarding a prize associated with the predefined pattern to the player.

Other advantages and features of the present invention will become apparent after review of the hereinafter set forth Description of the Drawings, Detailed Description of the Invention, and the Claims.

DETAILED DESCRIPTION OF THE INVENTION

Figure 1:
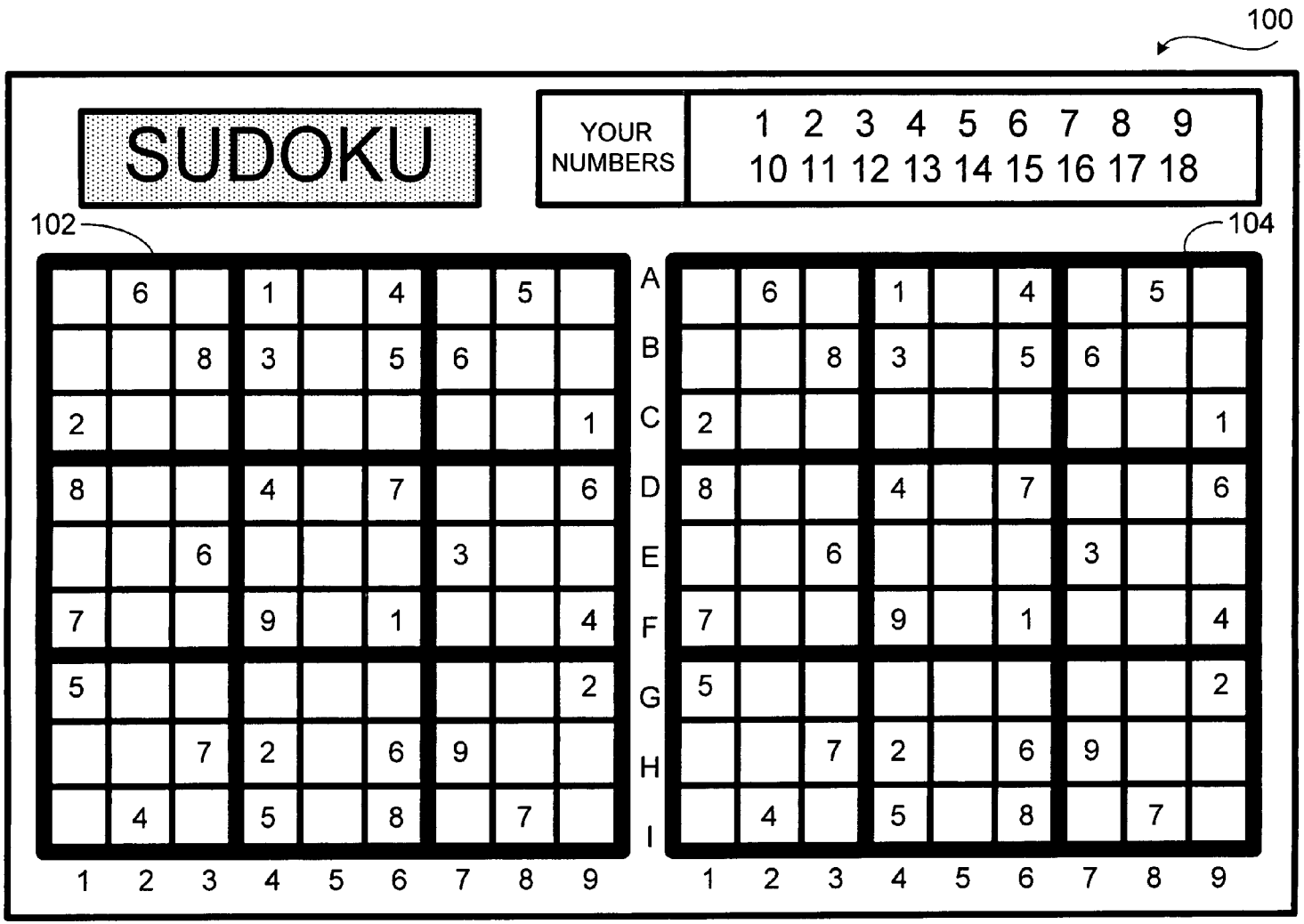
FIG. 1 illustrates a scratch-off number matching game card with Sudoku game according to a first embodiment of the invention.

Briefly described, in one embodiment the invention is a lottery game card having a flat substrate in which a plurality of squares is distributed in two matrix forms. The substrate may be of suitable card stock material on which printing can be received, generally of paper. The squares of a first matrix are populated with digits (also known as game symbols) and some of the digits of the first matrix are covered by a removable material. Some selected squares of a second matrix are populated with digits and the rest of the squares of the second matrix are left blank. A player may play a Sudoku game on the second matrix and then compare his game with the result provided in the first matrix after removing the removable material form the covered squares. A prize is provided based on the result of the game provided on the first matrix. FIG. 1 illustrates a lottery game card 100 for a scratch-off number matching game with a Sudoku game according to one embodiment of the invention. The lottery game card includes two 9×9 matrices, each matrix includes 81 squares. Each row of the matrix is identified by a letter and each column of the matrix is identified by a number. The squares of one matrix are populated with digits ranged 1 to 9 and some squares of this matrix are covered by a removable material, such as latex or other scratch-off material. Selected squares of another matrix are populated with digits ranged 1 to 9 and the rest of squares of this matrix are left blank. The placement of the digits in the matrix forms a Sudoku puzzle. Those skilled in the art will appreciate that other size of matrix and the digit range other than 1 to 9 may be employed. The lottery game card also includes a plurality of game indicia labeled as "YOUR NUMBERS." These game indicia are initially covered by a removable material. The lottery game card may include a prize table (not shown), which may be located on the back or front of the lottery game card, and a set of game instructions (not shown).

Figure 2:
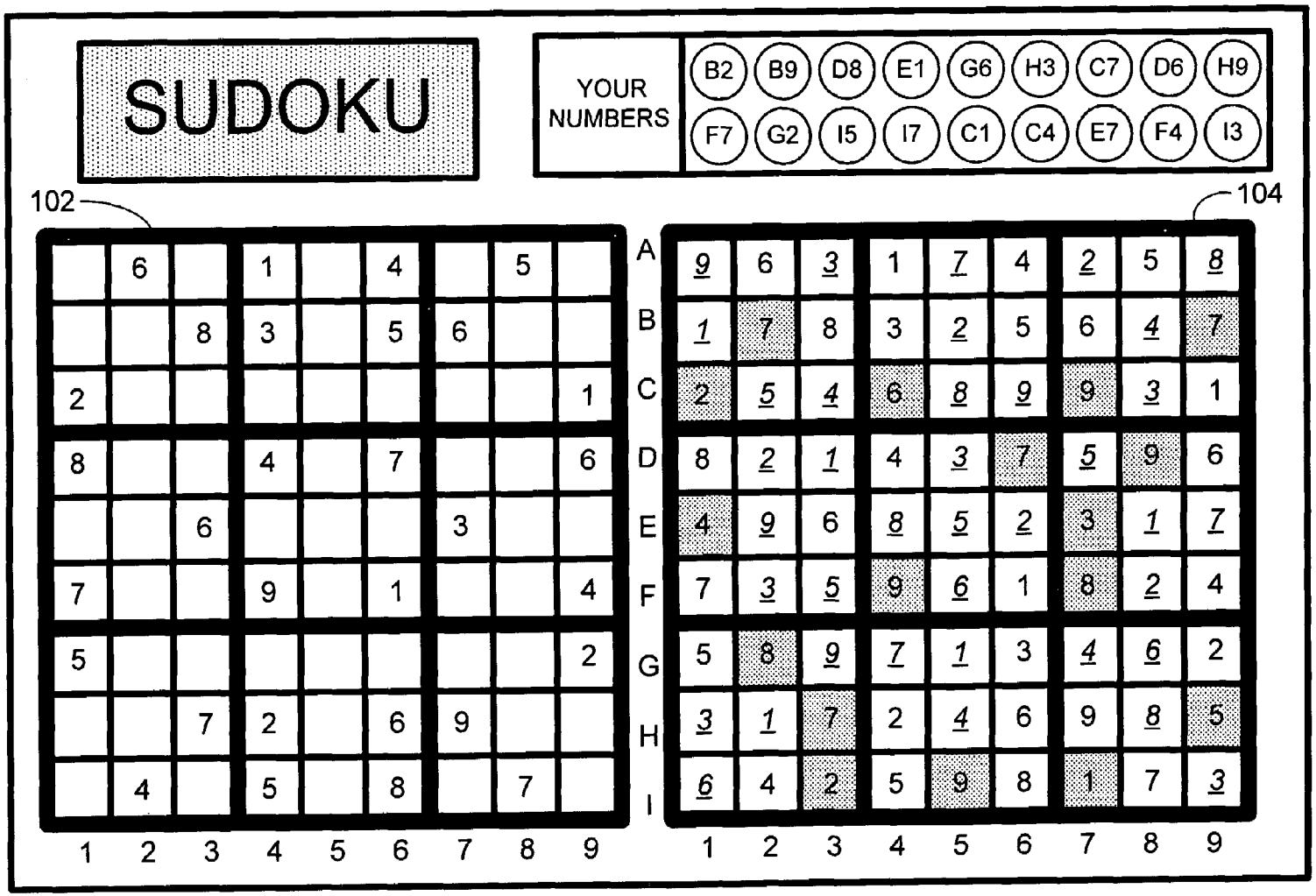
FIG. 2 illustrates the scratch-off game card of FIG. 1 with spots revealed.

After a player purchases a lottery game card 100, the player may play the Sudoku puzzle on the game matrix 102 that does not have the squares covered. When the player is done playing the Sudoku puzzle (Sudoku game), the player may then scratch off the removable material from the squares of the other matrix (answer matrix 104) as well as the removable material from the game indicia area. FIG. 2 illustrates an answer matrix 104 with squares uncovered. The player can compare his Sudoku game with the answer provided by the answer matrix 104. The player can also check whether he has won any prize by comparing the game indicia (YOUR NUMBERS) revealed with the digits printed on the answer matrix 102. The game indicia are a list of game coordinate pairs, each pair identifying a particular square. If the digits in the answer matrix 104 identified by the game indicia reveal certain pattern, the player wins a prize associated with that pattern. For example, one set of patterns is a number matching scheme listed in the "PRIZE LEGEND" area of FIG. 3. According to this exemplary rule, if there are four matching numbers, the player wins $5. In the answer matrix 104 shown in FIG. 2, there four "7," and four "9." Therefore, according to the "PRIZE LEGEND" shown in FIG. 3, the player wins $5 for four matching "7" and $5 for four matching "9." Those skilled in the art would appreciate that other prize winning patterns may be adopted.

Figure 3:
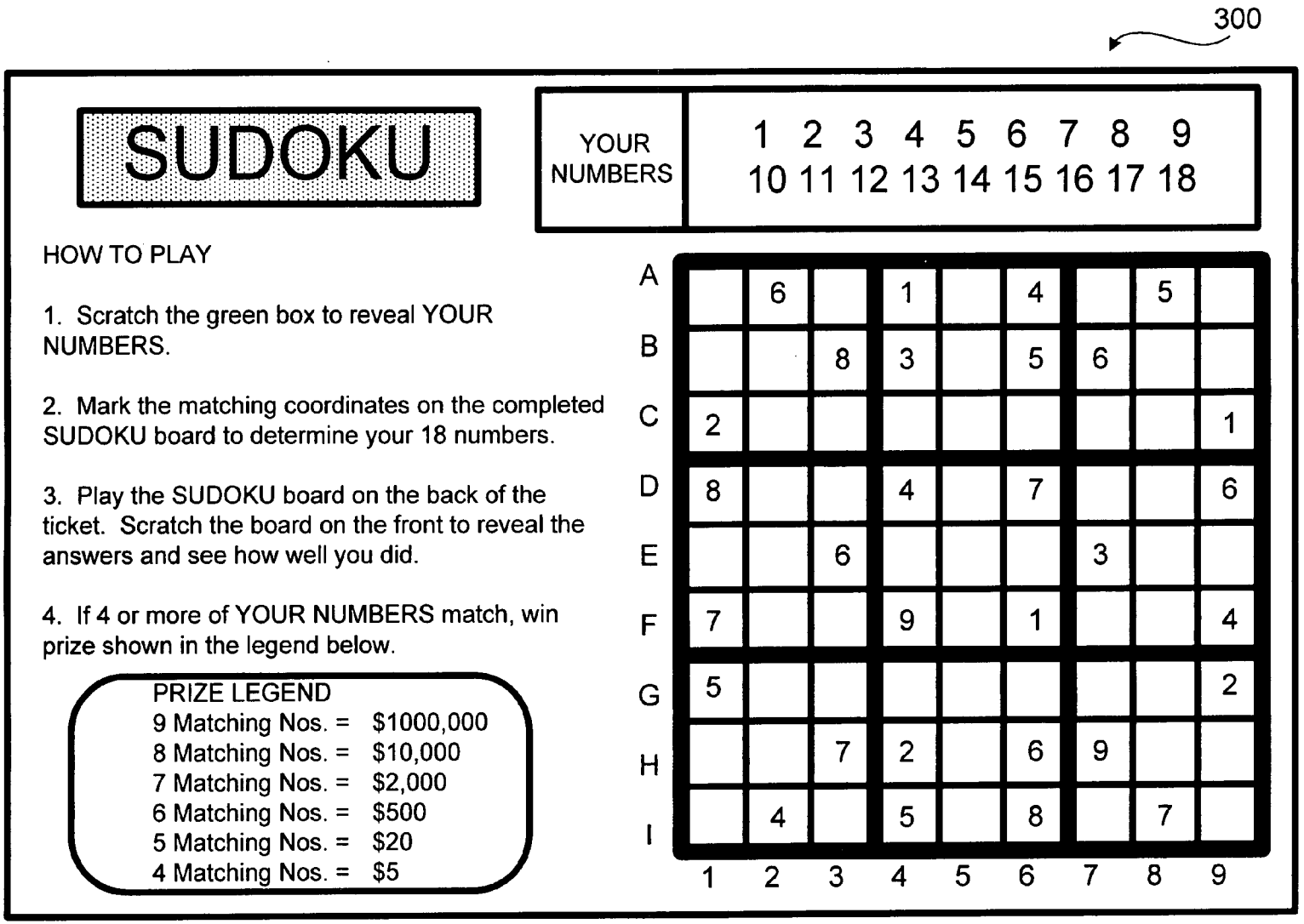
FIG. 3 illustrates a scratch-off number matching game card with Sudoku game according to a second embodiment of the invention.
Figure 4:
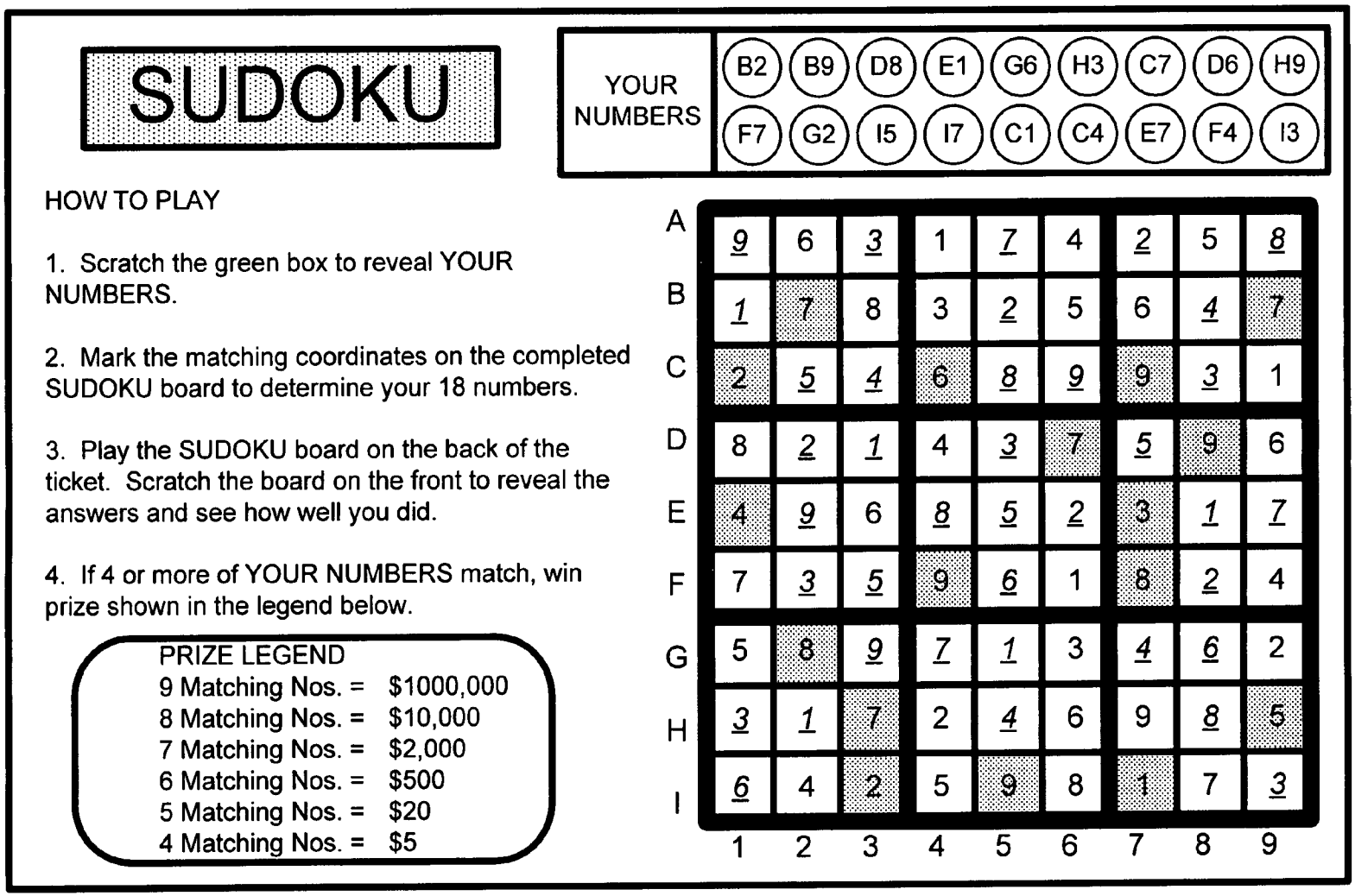
FIG. 4 illustrates the scratch-off game card of FIG. 3 with spots revealed.
Figure 5:
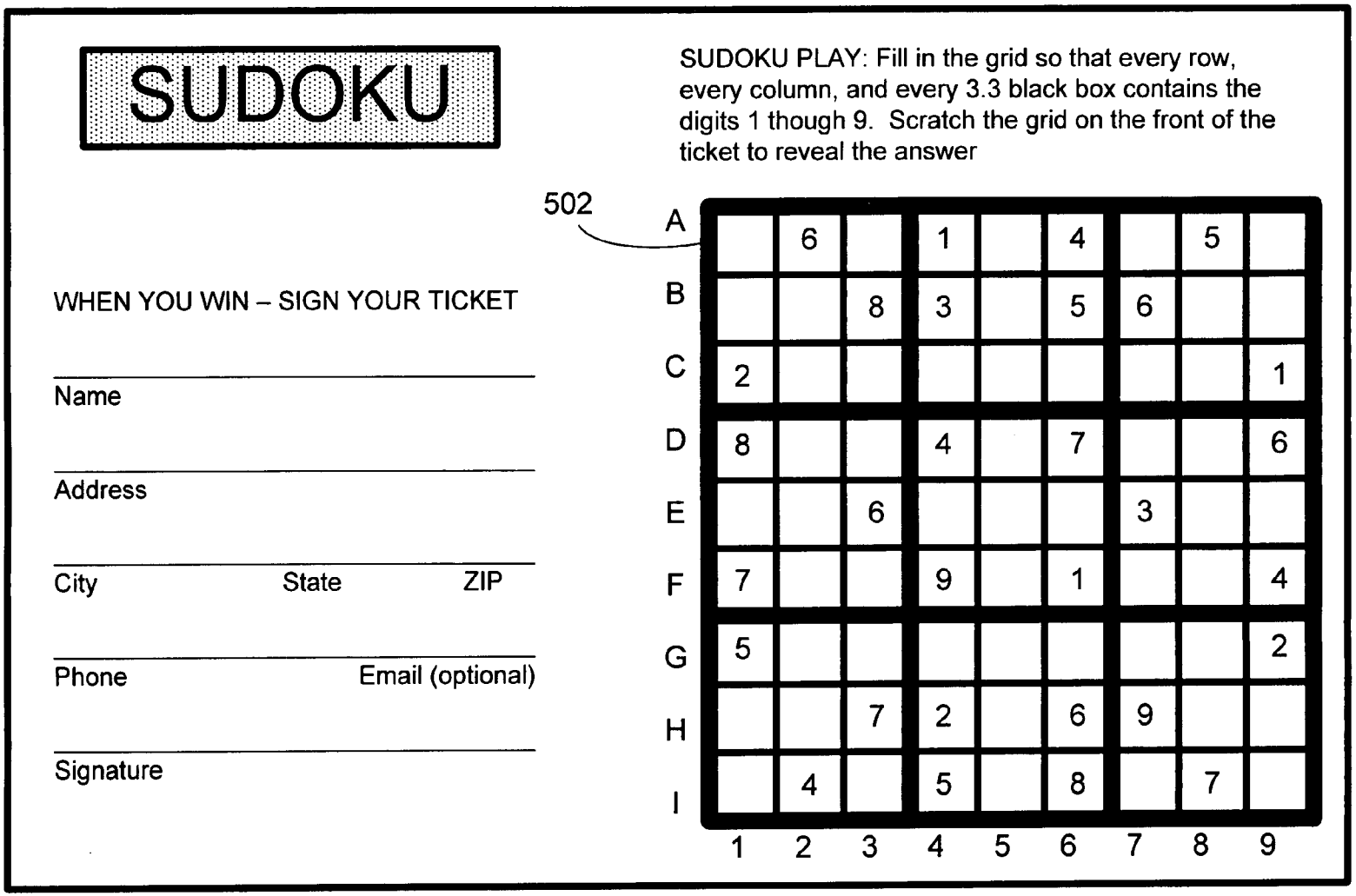
FIG. 5 illustrates back of the scratch-off game card of FIG. 3.

FIG. 3 illustrates another embodiment of a scratch off lottery game card 300. In this embodiment there is one matrix composed of 81 squares, each square having a digit. Selected squares are covered with a removable material. The matrix has 9 rows and 9 columns; each row is identified by a letter and each column is identified by a number. There is also an area for game indicia listed as "YOUR NUMBERS." The game indicia are covered initially by the removable material. The lottery game card 300 may includes a game matrix 502 printed on its backside as shown in FIG. 5. The game matrix preferably includes identical digits shown in the front side. After a player buys a lottery game ticket of FIG. 3, the player may play the Sudoku game using the game matrix 502 on its backside. Alternatively, the player may simply remove the removable material from the covered squares to reveal the hidden digits. After the digits are revealed, the player may scratch off the removable material from the game indicia to reveal "YOUR NUMBERS." Each "YOUR NUMBER" is a pair of game coordinates identifying a square. Again, the player identifies all the digits in the squares identified by the game indicia and if certain pattern is revealed, the player wins a prize associated with that pattern. FIG. 4 illustrates the lottery game card of FIG. 3 with the game played. There are four "7" in the lottery game card shown in FIG. 4, and the player wins $5.

Figure 6:
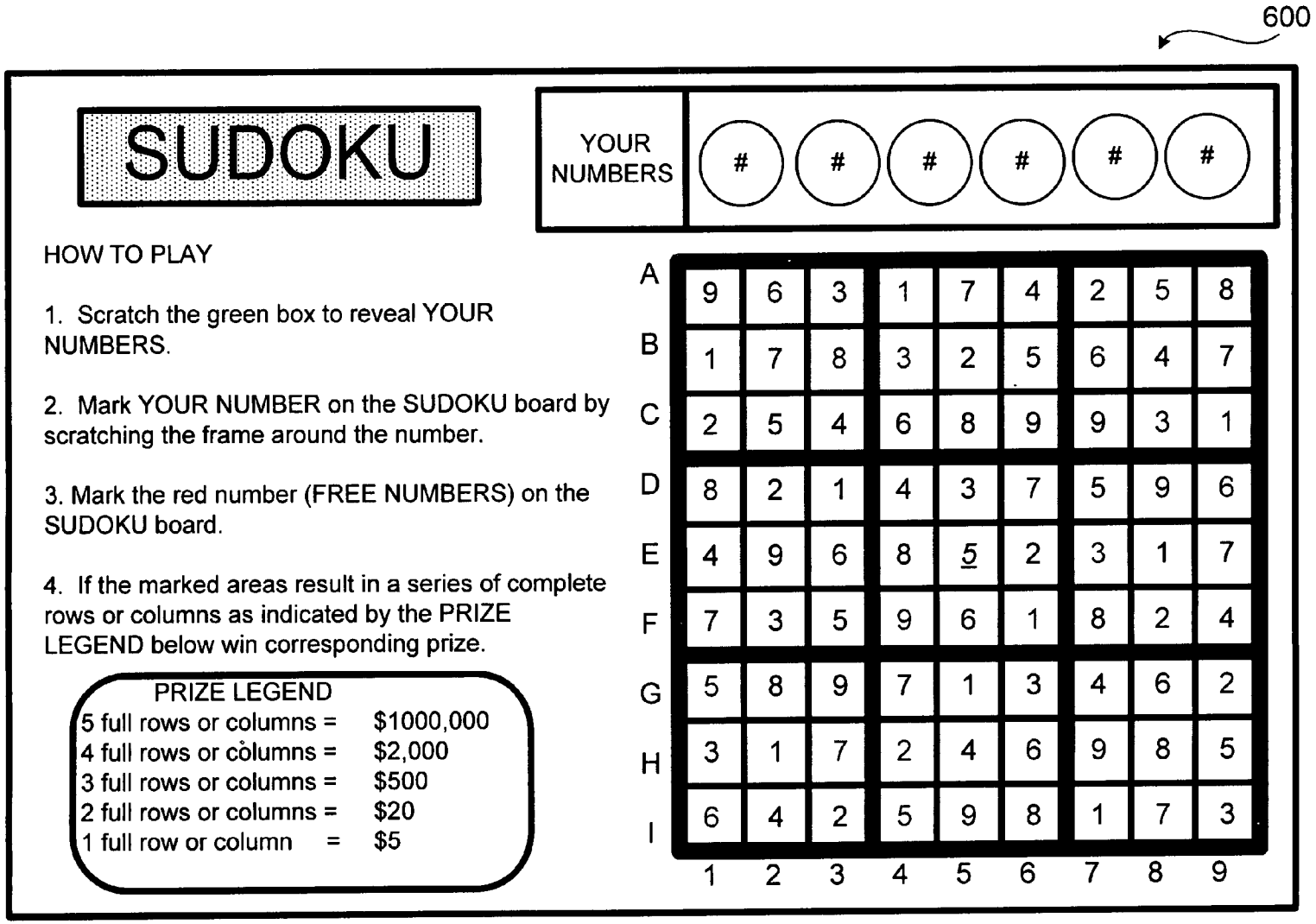
FIG. 6 illustrates a scratch-off game card with Sudoku game according to a third embodiment of the invention.
Figure 7:
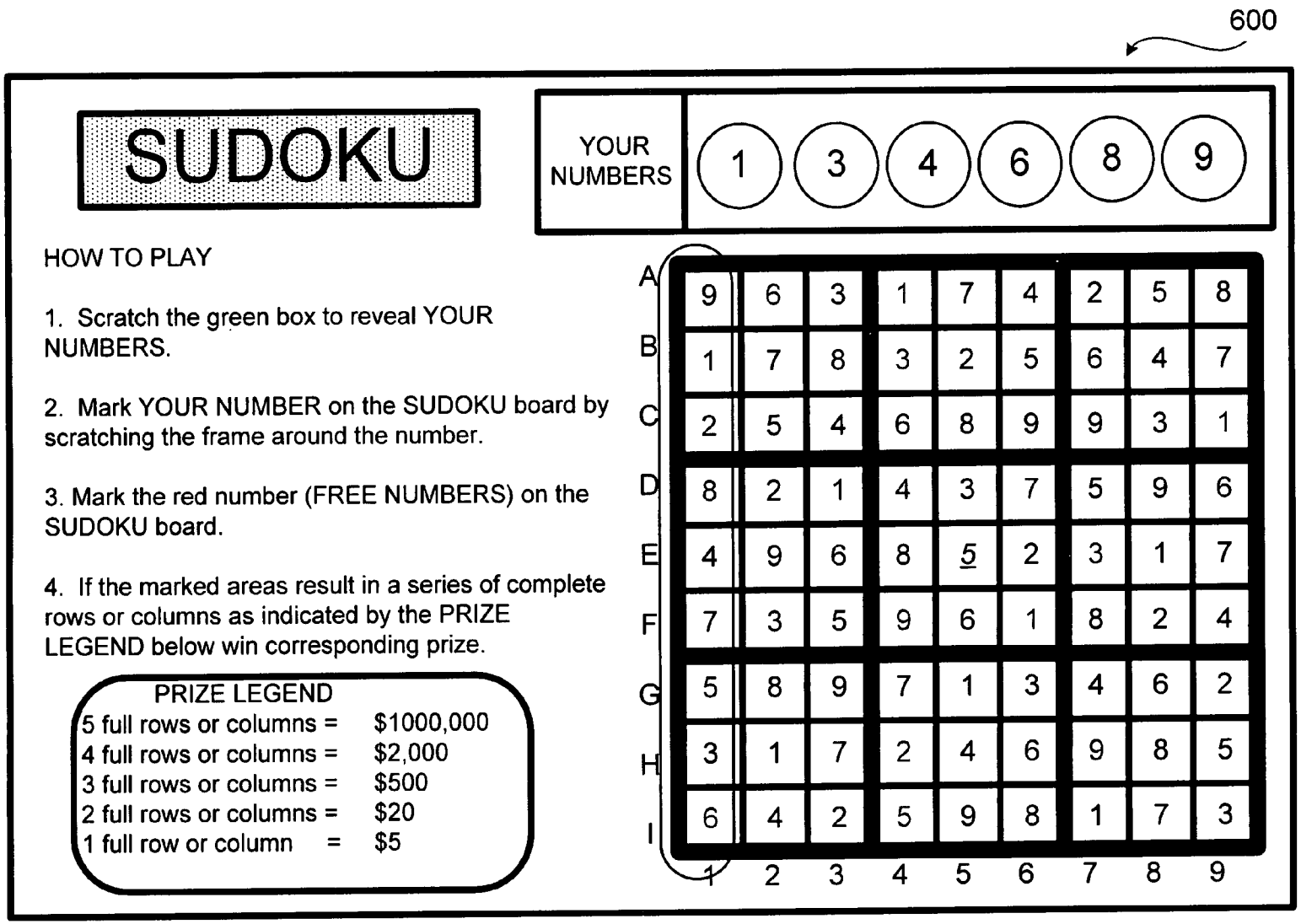
FIG. 7 illustrates the scratch-off game card with Sudoku game of FIG. 6 with the game played.

FIG. 6 depicts another scratch off lottery game card 600 according to an alternative embodiment of the invention. The lottery game card 600 includes a Sudoku-style game with digits distributed in a plurality of squares. Some digits are colored red and labeled as "FREE NUMBERS." A plurality of game indicia labeled as "YOUR NUMBERS" are initially covered by a removable material. After purchasing the lottery game card 600, a player can proceed to remove the removable material and reveal the game indicia (YOUR NUMBERS). FIG. 7 illustrates the lottery game card 600 with the game indicia revealed. The game indicia in FIG. 7 are digits. If the game indicia along with digits labeled as FREE NUMBERS (also known as ticket indicia) for a predefined pattern, the player wins a prize associated with that pattern. In the example shown in FIG. 7, the predefined patterns include full line or full row as shown in the "PRIZE LEGEND" shown in FIG. 7. The lottery game card 600 shown in FIG. 7 has column 1 populated with digits that are either a "FREE NUMBER" or a "YOUR NUMBER." Therefore, the player wins $5 for having a full column.

Figure 8:
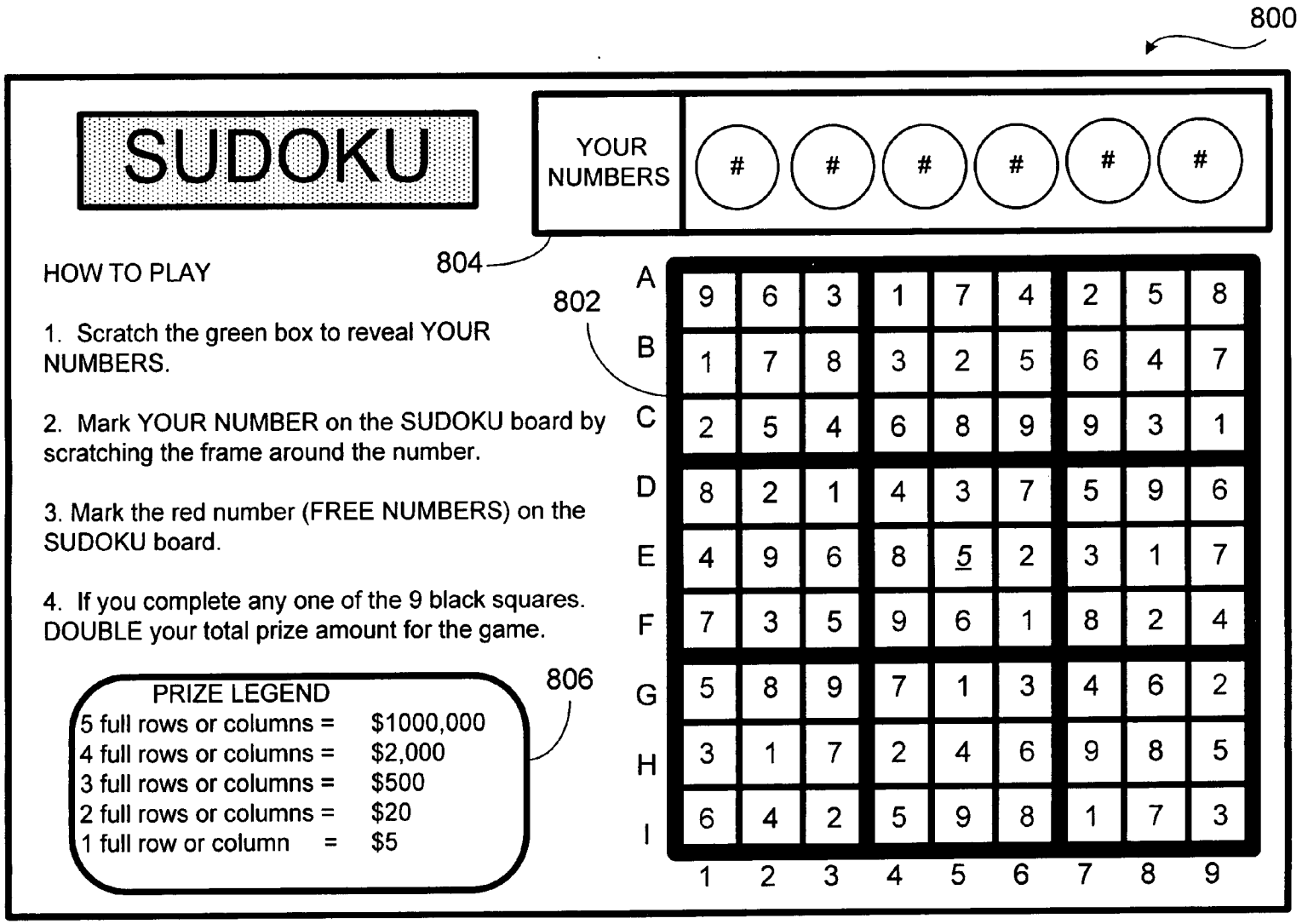
FIG. 8 illustrates a scratch-off game card with Sudoku game according to a fourth embodiment of the invention.
Figure 9:
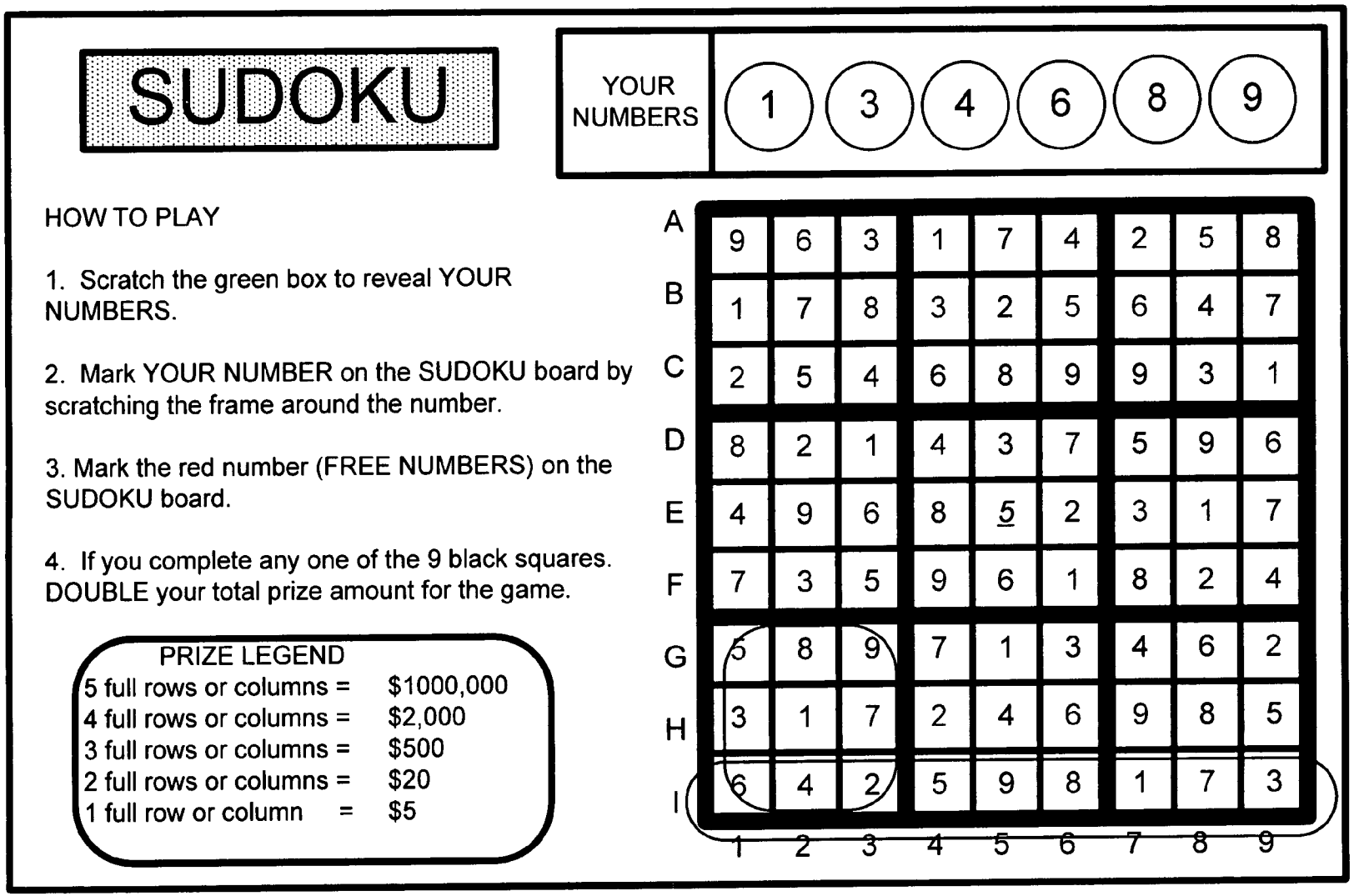
FIG. 9 illustrates the scratch-off game card with Sudoku game of FIG. 8 with the game played.

FIG. 8 illustrates a scratch lottery game card 800 that has a game rule slightly different from the game rules shown in FIGS. 6 and 7. The lottery game card 800 includes a game matrix 802, a plurality of game indicia 804, a prize table 806, and a set of game rules. The lottery game card 800 will entitle a player to a bonus by doubling the prize if a predefined pattern is identified in the lottery game card 800. The particular exemplary predefined pattern shown in the lottery game card 800 is a block of 3×3 black squares. Those skilled in the art will appreciate that bonuses may be given based on different patterns. After purchasing the lottery game card 800, the player removes the removable material to reveal the game indicia (YOUR NUMBERS). If the game indicia and FREE NUMBERS form a predefined pattern, the player wins a prize associated with the pattern. FIG. 9 shows that the game indicia and FREE NUMBERS for a full row, which entitles the player to $5 prize. FIG. 9 further shows that the game indicia and FREE NUMBERS also form a block of 3×3 squares at the lower left corner, which then entitles the player to double his winning to $10.

The visualization of a winning pattern may be challenging and difficult, however, this visualization may be assisted by a lottery game machine equipped with a scanner equipped with an optical recognition function. The player may scan the lottery game card (lottery ticket) at a lottery game retailer's site and the lottery game machine will be able to scan and identify if there is any winning pattern. After scanning the lottery game card and identifying the winning patterns, the lottery game machine can display the total wining to the player.

Figure 10:
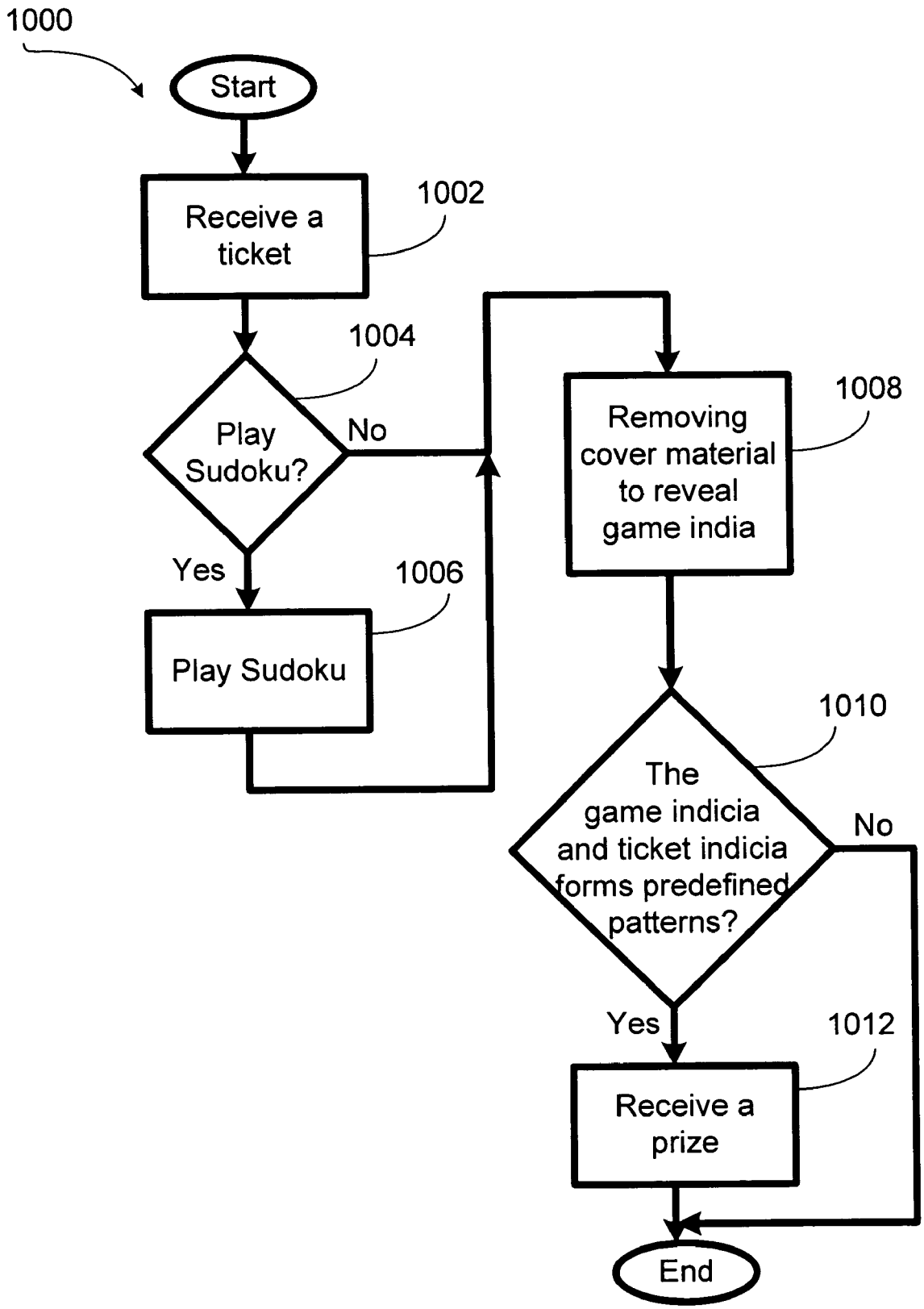
FIG. 10 is a flow chart for a game process.

FIG. 10 illustrates a user process 1000 for playing the lottery game card. A player buys a lottery game card and receives the game card, step 1002. After receiving the game card, the player may choose to play the Sudoku game, step 1006. Whether or not the player plays the Sudoku game, the player can remove the removable material to reveal the game indicia, step 1008. If the game indicia and ticket indicia form some predefined patterns, step 1010, the player is entitled to receive a prize, step 1012.

Although preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. Moreover, although specific terms are employed herein, as well as in the claims, they are used in a generic and descriptive sense only, and not for the purposes of limiting the described invention, nor the claims that follow below.

It should be appreciated that other symbols can be used, to include alpha-numeric symbols and other graphic symbols, emoticons, etc., within the matrix. Such symbols may or may not have mathematical connotation in conjunction with the Sudoku theme.

What is claimed is:

1. A scratch-off lottery game card with a Sudoku puzzle theme, comprising:

a substrate;

a plurality of game spaces displayed on said substrate in a Sudoku puzzle format having an N (column)×N (row) matrix, said matrix further divided into a block matrix having M (column)×M (row) blocks;

a plurality of game symbols comprising N different symbols, with a single game symbol placed in each of said game spaces such that said matrix defines a completed Sudoku puzzle wherein each different game symbol occurs only once in each said row, column, and block;

a plurality of said game spaces, but less than all of said game spaces, covered by a removable scratch-off material such that less than all of said completed Sudoku puzzle is visible to a player;

a plurality of player game indicia provided on said substrate and covered by a removable scratch-off material, said player game indicia identifying game spaces positions on said matrix or selected ones of said game symbols; and wherein upon playing of said game, a player removes said scratch-off material from said game spaces and said player game indicia, and if said identified game space positions identified by said player game indicia forms a predefined pattern in the completed Sudoku puzzle, a prize is awarded to the player.

2. The lottery game card of claim 1, wherein said game spaces are defined as squares.

3. The lottery game card of claim 1, wherein said player game indicia comprises coordinates on said matrix identifying unique game space positions, and said predefined pattern comprising a symbol matching scheme whereby the player is awarded a prize if the symbols in the game spaces identified by said coordinates contain a predefined number of matches.

4. The lottery game card of claim 1, wherein said player game indicia comprises a set of said game symbols, and said predefined pattern comprises a defined section of said matrix, whereby the player is awarded a prize if the set of player game symbols matches the game symbols in the defined section of said matrix.

5. The lottery game card as in claim 4, wherein said defined section of said matrix is at least one of a full row, a full column, or a full block within said matrix.

6. The lottery game card as in claim 4, wherein said defined section of said matrix is at least one of a full row or a full column within said matrix, and a bonus prize is awarded if the player game indicia also completes a full block within said matrix.

7. The lottery game card as in claim 1, wherein said matrix comprises a 9×9 grid of square game spaces, with a 3×3 grid of blocks, each said block defining a 3×3 grid of game spaces, and said game symbols comprise digits 1 through 9.

8. The lottery game card as in claim 1, further comprising a second matrix of game spaces arranged identical to said first matrix and displaying the same uncovered game symbols in the same game spaces as said first matrix, said second matrix presenting an unsolved Sudoku puzzle that the player may opt to solve prior to removing said scratch-off material from said game spaces in said first matrix to reveal the solution to said unsolved Sudoku puzzle.

* * * * *